US007273461B2

(12) United States Patent
Baek

(10) Patent No.: US 7,273,461 B2
(45) Date of Patent: Sep. 25, 2007

(54) LEG MASSAGER USING AIR

(75) Inventor: Hee-Jong Baek, Gwangju (KR)

(73) Assignee: Inarex Co., Ltd., Gwangju (KR)

( * ) Notice: Subject to any disclaimer, the term of this patent is extended or adjusted under 35 U.S.C. 154(b) by 0 days.

(21) Appl. No.: 11/589,441

(22) Filed: Oct. 30, 2006

(65) Prior Publication Data

US 2007/0106186 A1 May 10, 2007

(30) Foreign Application Priority Data

Oct. 31, 2005 (KR) ..... 10-2005-0103280

(51) Int. Cl.
*A61H 9/00* (2006.01)
*A61H 7/00* (2006.01)

(52) U.S. Cl. ..... 601/151; 601/134; 601/148; 601/149

(58) Field of Classification Search ..... 601/22, 601/33, 34, 35, 84, 133, 134, 148, 149, 150, 601/151, 152; 602/13; 128/DIG. 20
See application file for complete search history.

(56) References Cited

U.S. PATENT DOCUMENTS

| | | | | |
|---|---|---|---|---|
| 6,315,744 | B1 * | 11/2001 | Inaba | 601/149 |
| 6,361,512 | B1 * | 3/2002 | Mackay et al. | 601/150 |
| 6,491,652 | B1 * | 12/2002 | Hata et al. | 601/151 |
| 6,969,361 | B2 * | 11/2005 | Hsieh | 601/127 |
| 6,984,197 | B2 * | 1/2006 | Sugiyama et al. | 601/35 |
| 7,195,604 | B2 * | 3/2007 | Nakamura et al. | 601/136 |

* cited by examiner

*Primary Examiner*—Quang D. Thanh
(74) *Attorney, Agent, or Firm*—Ladas & Parry LLP

(57) ABSTRACT

A leg massage using air is provided. The leg massager includes a U-shaped massaging portion, a supporting frame, an air tank, an air supply controller, a rotating plate, an optical sensor, an air pump, and a control unit. The control unit determines a rotation angle of the rotating plate through the optical sensor, to control the operation of the air pump and the supply of compressed air to the air pads.

3 Claims, 3 Drawing Sheets

LEG MASSAGER USING AIR

BACKGROUND OF THE INVENTION

1. Field of the Invention

The present invention relates to a leg massager that uses air, and more particularly, to a leg massager that uses air to provide increased user convenience through more accurate controlling and reduced noise, and allow not only easy expanding and contracting of an air pad with the supplied air, but also provide maximum massaging benefits by controlling pressure from a drive motor.

2. Description of the Related Art

Personal health is a priority for many, and the practice of lightly pounding or massaging portions of the body to stimulate blood circulation for relieving fatigue and stress to restore, maintain, and even ameliorate health is of popular interest. Thus, there is a wide variety of massaging devices that have been developed and are currently being used. These include: massaging devices with an acupressure function for massaging certain portions of the body including calves, wrists, the waist, feet, etc. to relax tightened muscles or conduct acupressure; massaging chairs for providing a massage in a seated position; and thermoelectric therapy machines for use on prone patients in hospitals.

In the case of a thermotherapy device that applies acupressure on the upper and lower body, a moving carriage with a plurality of rollers that moves in an up-and-down or left-and-right direction is used. However, unlike the upper body, the lower body can continuously disengage from the rollers on the carriage, so that sufficient massaging of the lower body is not provided, inconveniencing the user.

In the case of a leg and calf massager, a pair of U-shaped medical-type indented portions are disposed between a left, right, and middle wall to contain legs and calves. An air bag is attached on each inner surface of the indented portions. Inflating and deflating the air bags allow legs and calves to be massaged by providing pressure on them. In the related art, solenoid valves, rotary plate valves, or stepping motors, and various sensors are used to control the air pressure during inflating and deflating, and the inflating and deflating of air is performed using piston or diaphragm-type air pumps.

However, although solenoid valves provide precise control, they are excessively noisy and are thus unpleasant to a user. Conversely, rotary plate valves emit minimal noise, but cannot provide precise control, and are thus prone to induce accidents. When a step motor and various sensors are installed, an acupressure function can be realized; however, the components used are expensive, so that manufacturing cost rises and related yield decreases.

Additionally, a piston-type air pump emits excessive noise and vibration due to the fast reciprocating piston, and a diaphragm-type air pump requires a solenoid (which has low pressure and volume capacity) and creates excessive noise and vibration at high speeds.

SUMMARY OF THE INVENTION

Accordingly, the present invention is directed to a leg massager using air that substantially obviates one or more problems due to limitations and disadvantages of the related art.

An object of the present invention is to provide a leg massager that not only obtains accurate controlling ability through the use of an installed optical sensor, but also uses a motor with a gearbox for quiet operation and an increased level of convenience for a user. Also, the inflating and deflating of air pads can easily be performed by supplying and discharging air, and the noise and vibration emitted by the air pump can be minimized using a timing belt. Furthermore, massaging effectiveness can be increased by using a pressure sensor to easily regulate the air pressure from the air pump.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a leg massager of the type using air and having a U-shaped massaging portion for containing a user's legs and including air pads installed on inner sides thereof, a supporting frame for supporting the massaging portion, and an air tank for supplying compressed air to the air pads, wherein the leg massager includes: an air supply controller connected to the air pads through air hoses and including an upwardly and downwardly-moving piston valve within, the piston valve having an air inlet formed in one side thereof and a pad port formed in an opposite side thereof, the piston valve for supplying air from the air inlet through the pad port over a predetermined duration to the air pads; a rotating plate rotating correspondingly to a position of an end of the piston valve, the rotating plate driven by a geared motor attached to one side thereof and including a timing hole formed at an outer perimeter thereof; an optical sensor installed on the air supply controller to a bracket thereon at a level corresponding to the timing hole; an air pump connected to the air tank, and including an eccentric pulley, a driving motor, a timing belt, and a pair of pistons, the eccentric pulley connected by the timing belt to the driving motor for driving the pair of pistons to suction and discharge air into and out from the air pump; and a control unit determining a rotation angle of the rotating plate through the optical sensor, for controlling an operation of the air pump and the supply of compressed air to the air pads.

Here, the piston valve may be a cylinder with a predetermined length, and may have a plurality of sealing rims formed to protrude from around an outer perimeter thereof at predetermined intervals to open and seal the pad port.

The air tank may include a pressure sensor provided at a side thereof for sensing a pressure and quantity of the compressed air.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
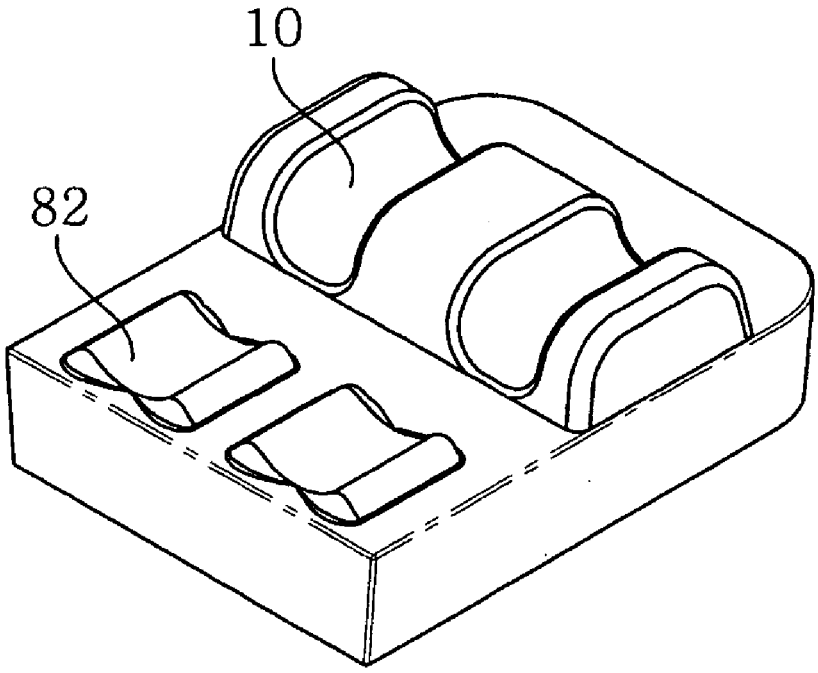
FIG. 1 is a perspective view of a leg massager that uses air, according to the present invention.
Figure 2:
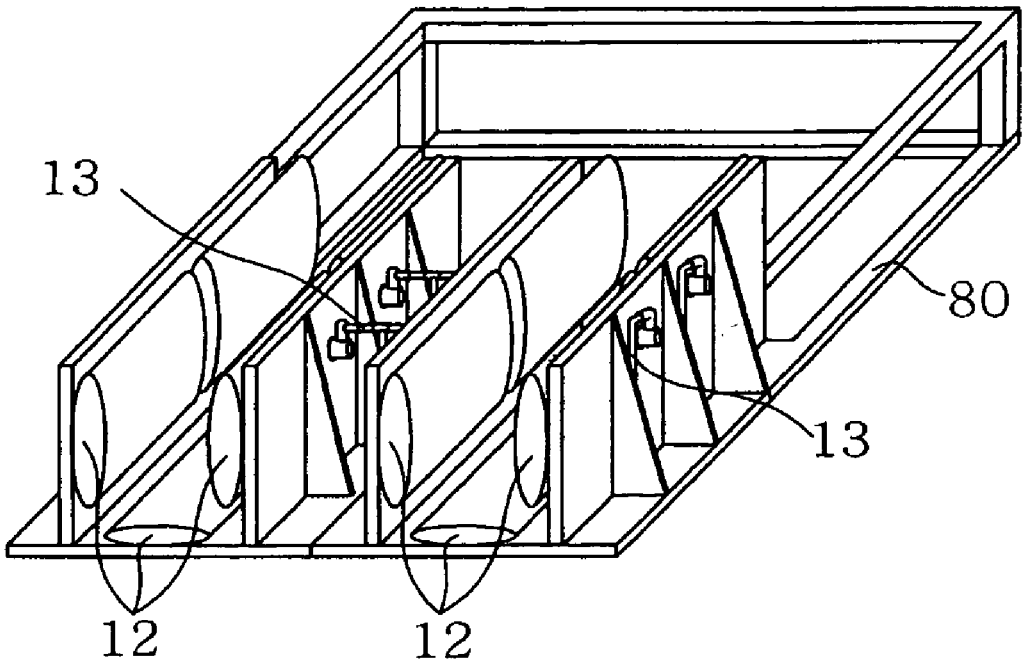
FIG. 2 is a schematic perspective view of the structure of a leg massager that uses air, according to the present invention.
Figure 3:
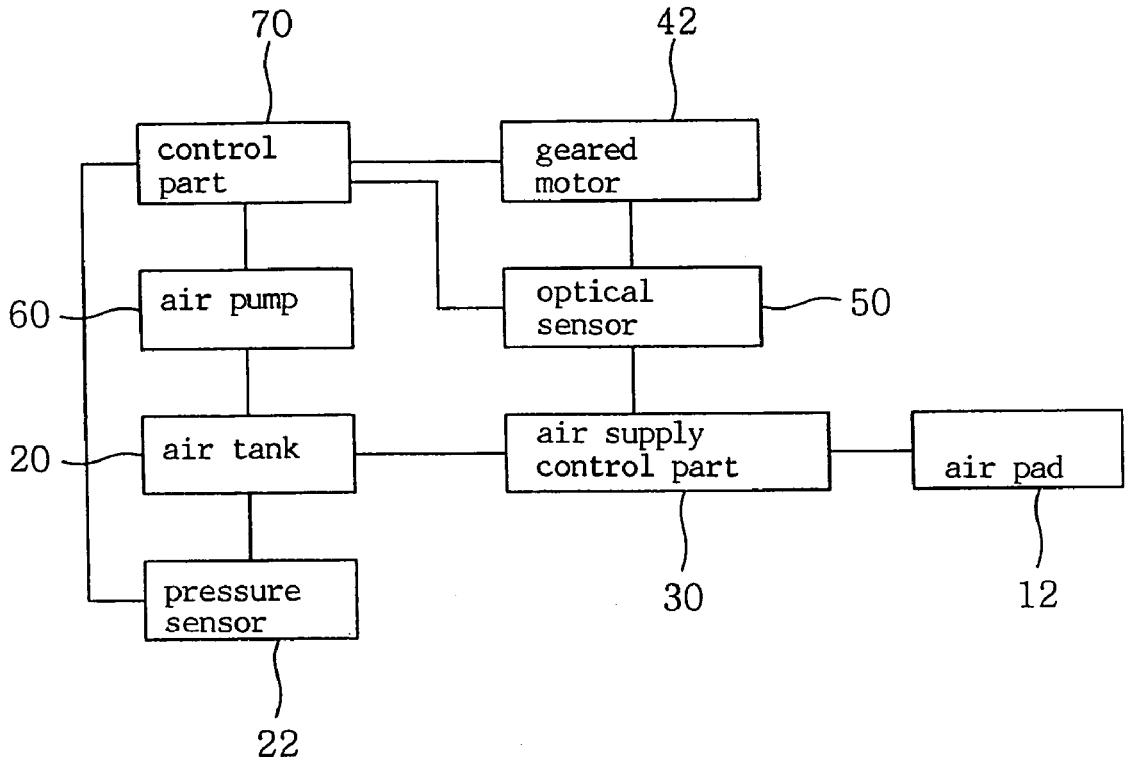
FIG. 3 is a schematic block diagram of the system of a leg massager that uses air, according to the present invention.
Figure 4:
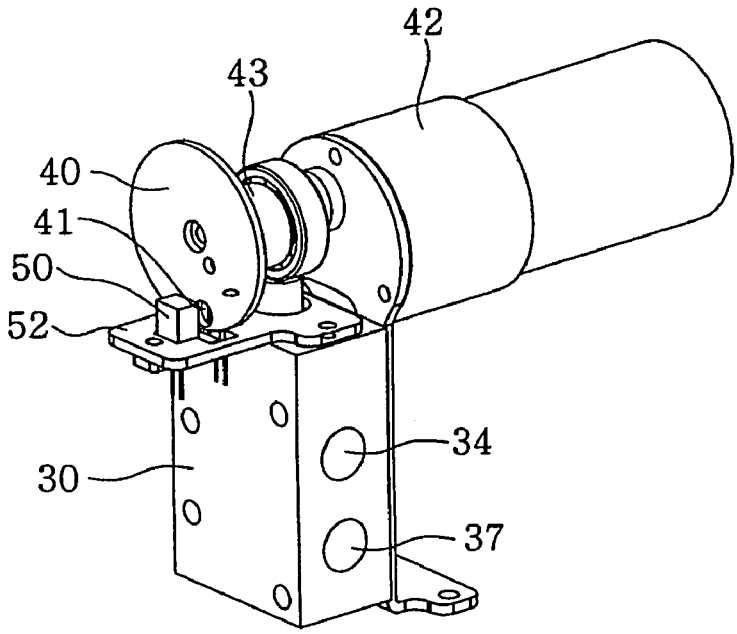
FIG. 4 is a perspective view showing an air supply controller, an optical sensor, and a rotating plate, according to the present invention.
Figure 5:
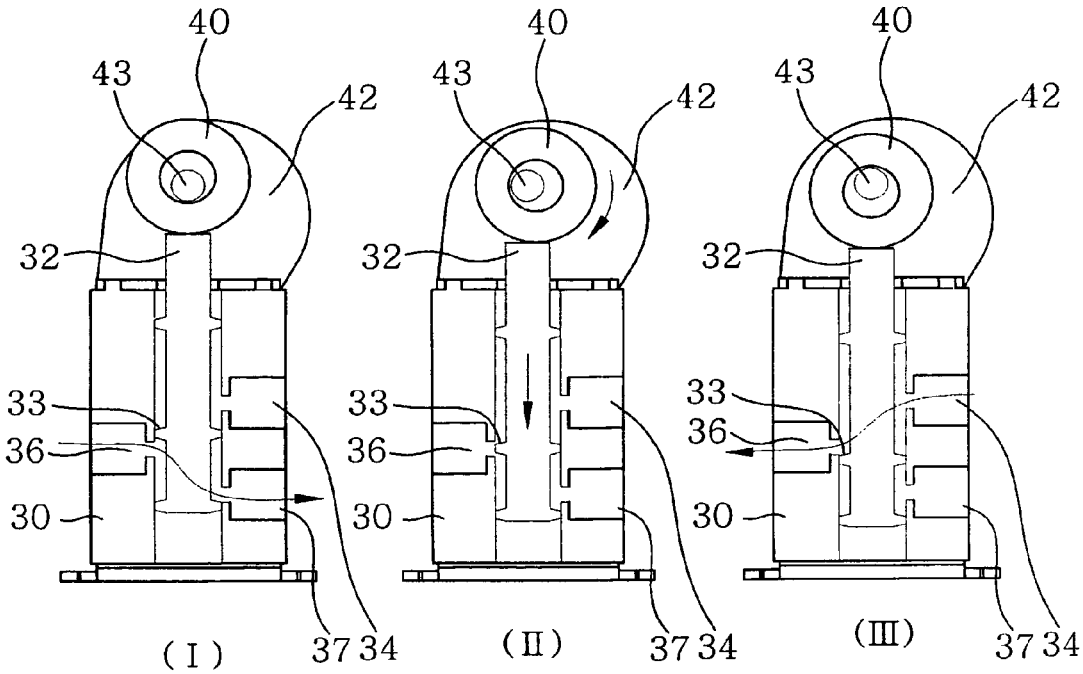
FIGS. 5I through 5III are plan views showing different positions of a piston valve depending on the rotation of a rotating plate, according to the present invention.
Figure 6:
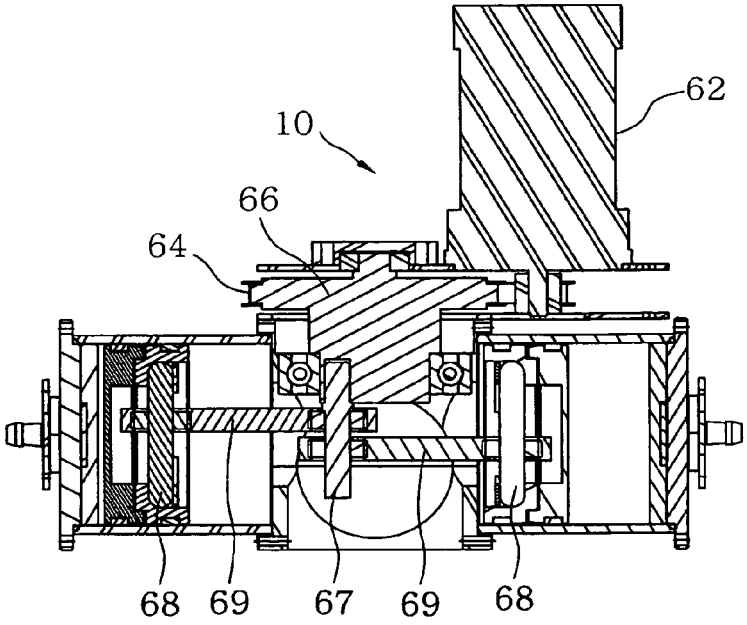
FIG. 6 is a sectional view of an air pump according to the present invention.

FIG. 1 is a perspective view of a leg massager that uses air, according to present invention, FIG. 2 is a schematic perspective view of the structure of a leg massager that uses air, according to the present invention, FIG. 3 is a schematic block diagram of the system of a leg massager that uses air, according to the present invention, FIG. 4 is a perspective view showing an air supply controller, an optical sensor, and a rotating plate, according to the present invention, FIGS. 5I through 5III are plan views showing different positions of a piston valve depending on the rotation of a rotating plate, according to the present invention, and FIG. 6 is a sectional view of an air pump according to the present invention.

Referring to FIGS. 1 through 6, a leg massager using air, according to a first embodiment of the present invention includes a U-shaped massaging portion 10 for containing legs and having air pads 12 installed on the inner sides thereof, a supporting frame 80 for supporting the massaging portion 10, and an air tank 20 for supplying compressed air to the air pads 12.

Main components of the leg massager according to the present invention also include an air supply controller 30 connected to the air pads 12 through air hoses 13 and having an upward and downwardly-moving piston valve 32 within, a rotating plate 40 that rotates correspondingly to a position of the end of the piston valve 32 of the air supply controller 30 and having a timing hole formed around an outer perimeter thereof, an optical sensor 50 installed on a bracket 52 on the air supply controller 30 at a level corresponding to the timing hole 41 of the rotating plate 40, an air pump 60 connected to the air tank 20, and a control unit 70 for controlling the operation of the air pump 60 and the supply of pressurized air to the air pads 12 by determining the rotation angle of the rotating plate 40 by means of the optical sensor 50.

The air supply controller 30 has an air inlet 34 and an air outlet 37 formed on one side thereof, a pad port 36 formed on the other side, and a cylinder 38 formed therein, within which the piston valve 32 moves up and down.

Here, the piston valve 32 is cylindrical in shape with a predetermined length, and has sealing rims 33 formed therearound at predetermined intervals to open and seal the opening of the pad port 36.

Accordingly, when the piston valve 32 reciprocates up and down, the sealing rims 33 open and closes the pad port 36. Air that enters through the air inlet 34 is supplied to the air pads 12 through the pad port 36. That is, the piston valve 32 is moved according to the rotation of the rotating plate 40 to open and close the air inlet 34 in order to supply air to the air pads 12 for a certain duration.

In other words, before the geared motor 42 is operated, the piston valve 32 is in an elevated position, so that it is at the closest distance to the axis of the cam 43 of the guide motor 42. Here, the pad port 36 and the air outlet 37 communicate so that the air supplied to the air pads 12 are discharged to the outside. When the geared motor 42 is operated to turn the cam 43 and the connected rotating plate 40 90°, the piston valve 32 is moved downward, so that the sealing rim 33 protruding from the outer circumference of the piston valve 32 closes the opening of the pad port 36. When the cam 43 and the rotating plate 40 connected to it are rotated beyond 90° to 180°, the piston valve 32 moves further downward so that the pad port 36 is opened and communicates with the air inlet 34. Thus, the compressed air supplied by the air pump 60 enters the air pads 12.

Here, when the rotating plate 40 is rotated 180°, the optical sensor 50 and the timing hole 41 in the rotating plate 40 align so that the control unit 70 receives a signal from the optical sensor to determine the exact rotational angle of the rotating plate 40.

Accordingly, the control unit 70 accurately controls the operation of the geared motor 42 based on the operating status of the air supply controller 30, in order to easily control the pressure, speed, and intervals at which the air is supplied to the air pads 12.

Also, in order for the control unit 70 to easily control the operation of the air pump 60, a pressure sensor 22 is provided in the air tank 20 that is connected to the air pump 60. In this way, the pressure and quantity of pressurized air in the air tank 20 can be measured. Here, the control unit 70 compares the data from the pressure sensor 22 with data on the compressed air compressed by the air pump 60 and sent to the air tank 20 to control the air pump 60.

The air pump 60 suctions and discharges air using a pair of pistons 68 coupled through piston rods 69 to an eccentric pulley 66 that is driven by a driving motor 62. In order to minimize noise and vibration generated when the pistons 68 operate, the driving motor 62 and the eccentric pulley 66 may be connected by a timing belt 64.

The leg massager according to the present invention may include a foot rest 82 provided at one end of the massaging portion 10 on the supporting frame 80 to rest a user's heels. Furthermore, the inventive leg massager may be made compatible with conventional thermotherapy machines so that they may be installed and used together. In the latter case, the leg massager may be made so that its controls can be connected to the main control unit of the thermotherapy machine to be thereby controlled.

The function and effect of the above-structured leg massager according to the present invention depend on the pressurized state of the air pads according to the position of the piston valve.

After turning the power switch (not shown) of the control unit 70 to an ON position, when the geared motor 42 is operated, the cam 43 rotates so that the attached rotating plate 40 also rotates, and reciprocates the piston valve 32 up and down.

Here, before the geared motor 42 operates, the piston valve 32 is in an elevated position so that the pad port 36 connected to the air pads 12 through the air hoses 13 and the air outlet 37 communicate. Therefore, the air in the air pads 12 is discharged to the outside through the air outlet 37, as shown in FIG. 5I.

Then, when the geared motor 42 operates, the cam 43 and the connected rotating plate 40 rotate 90° so that the piston valve 32 descends. The sealing rim 33 protruding around the outer perimeter of the piston valve 32 closes the opening of the pad port 36 to block the discharging of air from the air pads 12, as shown in FIG. 5II.

When the cam 43 and the connected rotating plate 40 turn past 90° to 180°, the piston valve 32 is moved further downward to open the pad port 36 and communicate it with the air inlet 34, so that the pressurized air supplied by the air pump 60 enters the air pads 12, as shown in FIG. 5III.

When the rotating plate 40 turns 180°, the timing hole 41 of the rotating plate 40 and the optical sensor 50 align to send a signal to the control unit 70, whereupon the control unit 70 can accurately control the position of the piston valve 32 based on the received signal.

As the rotating plate 40 rotates, the same process is repeated to allow the control unit 70 to control the position of the piston valve 32 and regulate the pressure, speed, and interval at which air is supplied to the air pads 12.

The control unit 70 compares the air suctioned and discharged into and out of the air pump 60 with data from the sensor 22 provided in the air tank 20, in order to control the operation of the pistons 68 at an adequate level.

Thus, the pressure, speed, operating rhythm, and time interval at which the pressurized air enters the air pads 12 can be controlled to provide a massage with maximum effectiveness to a user.

The present invention provides a leg massager that not only obtains accurate controlling ability through the use of an installed optical sensor, but also uses a motor with a gearbox for quiet operation and an increased level of convenience for a user. Also, the inflating and deflating of air pads can easily be performed by supplying and discharging air, and the noise and vibration emitted by the air pump can be minimized using a timing belt. Furthermore, massaging effectiveness can be increased by using a pressure sensor to easily regulate the air pressure from the air pump.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A leg massager of the type using air and having a U-shaped massaging portion for containing a user's legs and including air pads installed on inner sides thereof, a supporting frame for supporting the massaging portion, and an air tank for supplying compressed air to the air pads, wherein the leg massager comprises:

an air supply controller connected to the air pads through air hoses and including an upwardly and downwardly-moving piston valve within, the air supply controller having an air inlet formed in one side thereof and a pad port formed in an opposite side thereof, the piston valve for supplying air from the air inlet through the pad port over a predetermined duration to the air pads;

a rotating plate rotating correspondingly to a position of an end of the piston valve, the rotating plate driven by a geared motor attached to one side thereof and including a timing hole formed at an outer perimeter thereof;

an optical sensor installed on the air supply controller to a bracket thereon at a level corresponding to the timing hole;

an air pump connected to the air tank, and including an eccentric pulley, a driving motor, a timing belt, and a pair of pistons, the eccentric pulley connected by the timing belt to the driving motor for driving the pair of pistons to suction and discharge air into and out from the air pump; and a control unit determining a rotation angle of the rotating plate through the optical sensor, for controlling an operation of the air pump and the supply of compressed air to the air pads.

2. The leg massager of claim 1, wherein the piston valve is a cylinder with a predetermined length, and has a plurality of sealing rims formed to protrude from around an outer perimeter thereof at predetermined intervals to open and seal the pad port.

3. The leg massager of claim 1, wherein the air tank comprises a pressure sensor provided at a side thereof for sensing a pressure and quantity of the compressed air.

* * * * *